United States Patent [19]

Lankford

[11] 4,172,542

[45] Oct. 30, 1979

[54] PAINT HOLDER

[76] Inventor: William O. Lankford, 1307 Coke St., San Angelo, Tex. 76903

[21] Appl. No.: 869,130

[22] Filed: Jan. 13, 1978

[51] Int. Cl.[2] ..... A45C 1/04

[52] U.S. Cl. ..... 224/148; 224/269; 206/1.7; 15/114

[58] Field of Search ..... 224/5 R, 5 W, 5 V, 5 A, 224/5 B, 5 G, 5 Q, 5 MA, 26 R, 26 B, 25 R; 220/17, 20.5, 23.86, 23; 206/1.7, 1.8, 81; 248/210, 310, 311.1, 360; 215/100 R; 15/114, 262, 257.05

[56] References Cited

U.S. PATENT DOCUMENTS

| | | | |
|---|---|---|---|
| 423,650 | 3/1890 | Wilkins | 224/5 W |
| 2,592,688 | 4/1952 | Halspup et al. | 224/25 R |
| 2,995,281 | 8/1961 | Dixon | 224/25 R |
| 3,380,635 | 4/1968 | Stone et al. | 224/5 W |
| 3,541,976 | 11/1970 | Rozas | 224/25 R |
| 3,983,993 | 10/1976 | Hsu | 224/5 W |
| 3,997,092 | 12/1976 | Pogwizd | 224/5 W |
| 4,040,547 | 8/1977 | Dickey | 224/5 H |

FOREIGN PATENT DOCUMENTS

| | | | |
|---|---|---|---|
| 381487 | 9/1923 | Fed. Rep. of Germany | 15/257.05 |

*Primary Examiner*—Robert J. Spar
*Assistant Examiner*—Kenneth Noland
*Attorney, Agent, or Firm*—Wendell Coffee

[57] ABSTRACT

A cylindrical paint case is provided to a supporting member. The supporting member includes an anchor arm which stabilizes the paint case with respect to the torso of the painter and an extension arm which supports the paint case. Caps having cups mounted thereon are fitted on paint cups within the paint case.

11 Claims, 6 Drawing Figures

PAINT HOLDER

BACKGROUND OF THE INVENTION (1) Field of the Invention

This invention relates to paint holders for sign painters, house painters and the like.

(2) Description of the Prior Art

One problem connected with the painting of signs and houses is the placement and positioning of the paint container. A house painter ordinarily places approximately a quart of paint in a paint container with a handle thereon and carries the paint container with him as he moves. The painter normally places the container on a platform or other convenient position and moves the container with him as the painting progresses. This is cumbersome and dangerous not only for the painter who is often negotiating precarious structures such as scaffolding, but also for persons beneath the painter.

This problem is greater in the case of sign painters who ordinarily must cary multiple containers of paint with them.

Prior to my invention, workers in the art conceived various devices to allow the painter to carry his paint with him. Some of these devices provide a hook upon which a paint bucket is hung. Others provide a pallet on which paint containers are placed, much as with a conventional artist's pallet.

Before this application was filed an independent search was made which found the following references. None of these seem particularly pertinent.

Shaw—437,519
Grill—696,331
Patnode et al—1,115,098
Ohman—1,494,183
Thompson—1,569,157
Seitz—1,579,368
Olesen—2,040,327
Van Winkle—2,095,333
Lambert—2,441,115
Keyes, Jr.—2,674,757
Whittmann—2,945,614
Ort—3,493,152
Israel—3,804,030
Hsu—3,983,993
Pogwizd—3,997,092

Some of the references are briefly described as follows:

WHITTMANN discloses a combination of a paint bucket and apron.

ORT discloses a belt hook by which is carried a shield, then the shield has on it a bucket hook and paint brush holders.

HSU discloses a combination of a canteen and a compartmentalized container for water colors and the cap is used to wash the brushes.

ISRAEL discloses a palette and a cover sheet. In addition to this, you will note that each of the paint containers 20 have a flange or ring 36 which support the paint can.

SHAW discloses a paint carrier wherein the paint is carried in a horn extending around the body and the paint flows out into a pallette.

KEYS discloses a paint carrier having a paint well which can be replenished from the main container of paint.

POGWIZD discloses a paint can holder with paint brush and scraper. Note particularly the slidable lid 24.

OLENSEN, GRILL, PATNODE ET AL, and SEITZ disclose fountain brushes. OHMAN and LAMBERT disclose bucket carriers for picking fruit and berries.

THOMPSON discloses a palette to be used for carrying beverages.

SUMMARY OF THE INVENTION

New and Different Function

I have invented a paint holder which allows a painter to carry his paint with him. Paint is conveniently disposed in front of the painter at waist height. The painter's hands, which would normally be employed to carry the paint bucket, are free to assist him in negotiating precarious structures such as ladders and scaffolds. Furthermore, my invention solves the problem of where to place such a paint container by positioning it on the person of the painter.

My invention permits use of the paint case while the painter is bent at the waist by pivoting the paint case with respect to the holder such that the top of the paint case is substantially horizontal when the painter is bent at the waist. A locking arm is connected to the paint case, thereby maintaining the paint case at an angle to the supporting member. The locking arm may be disconnected from the paint case and the paint case pivoted back to the former position for painting while erect.

The supporting arm which holds the paint carrier in my invention is conveniently clipped to the belt of a painter. My invention has a pad which bears against the person of the painter to stabilize the paint case. The pad is adjustable, both vertically and transversely of the painter to permit adjustment of the holder to fit the figure of almost any painter. A chamois covers the pad.

The paint case of my invention may be employed to carry a large amount of paint for painting large surfaces with a single color. Alternatively, a removable cover may be placed on the paint case and paint cups and a cleaner cup telescoped through holes therein. The cleaner cup has a brush wringer therein.

The paint cups each have a cap with a weight on one side and a cap cup on the other. The cap cups telescope within the paint cups when the caps are inverted. The cap cups may be placed in an upright position and the weight placed within the paint cups to provide two or more paint containers. This allows several colors of small amounts of paint to be carried with the painter. The brush may be cleaned with cleaning fluid in the cleaner cup when switching from one color to another. This mode of my invention is particularly adapted to sign painting.

My invention provides a substantial increment in the efficiency of painters. Therefore, the total functioning of my invention exceeds the sum of the functions of the individual cups, belt clips, pads, etc.

OBJECTS OF THE INVENTION

An object of this invention is to hold paint.

Another object of this invention is to position the paint holder conveniently on the torso of the painter.

Further objects are to achieve the above with a device that is sturdy, compact, durable, lightweight, simple, safe, efficient, versatile, ecologically compatible, energy conserving, and reliable, yet inexpensive and easy to manufacture, adjust, and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENT

Figure 1:
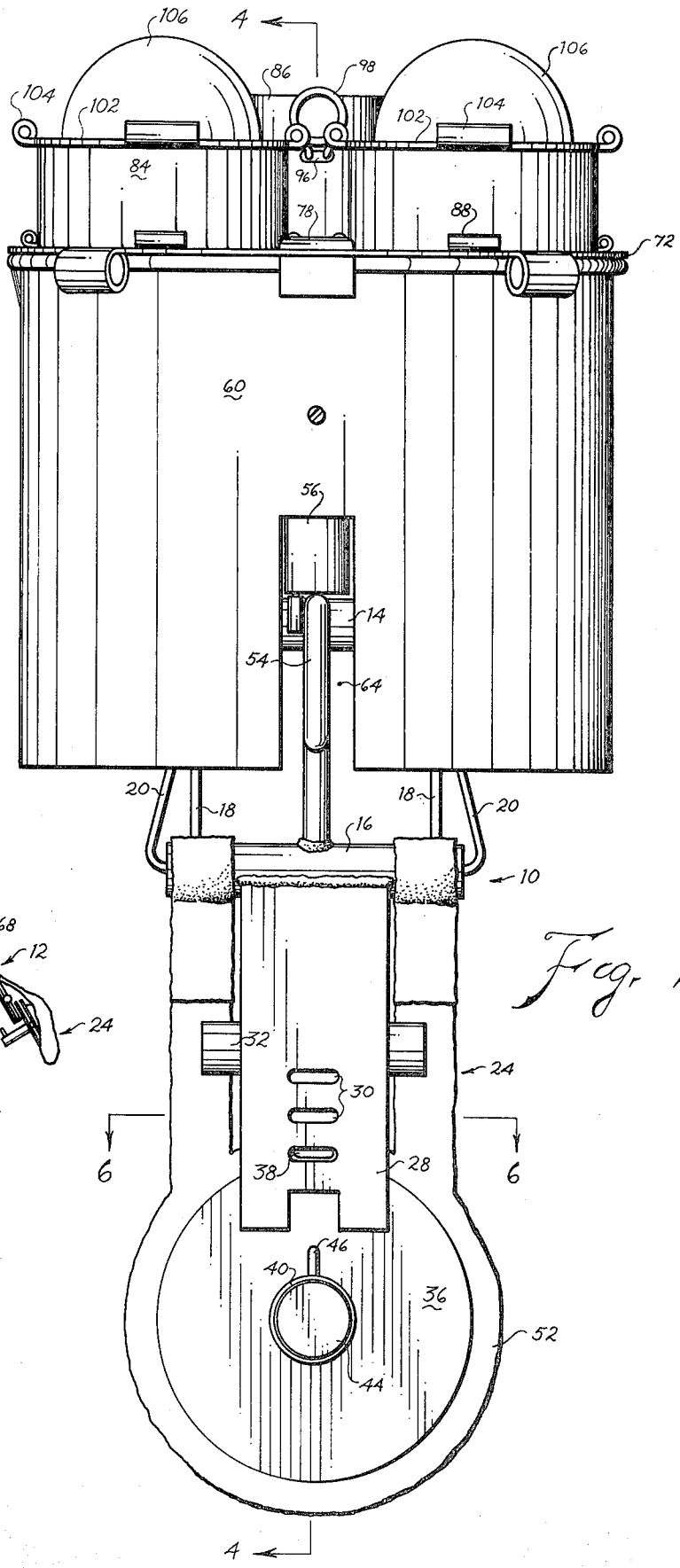
FIG. 1 is a front elevational view of an embodiment of my invention with cap cups in the inverted position.
Figure 3:
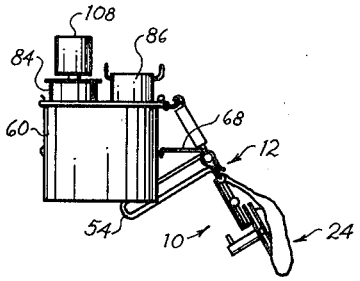
FIG. 3 is a side elevational view with the paint case in the tilted or kneeling position.

Supporting member 10 supports cylindrical paint case 60 to form a paint holder. The supporting member 10 includes base 12, anchor arm 24 and extension arm 54. The base 12 includes horizontal upper and lower bars 14 and 16 connected by braces 18. Belt clip 20 for clipping the base 12 to the belt of a painter depends from the upper bar 14 and is springably biased at the upper bar 14 such that the lower end of the belt clip 20 is biased toward the lower bar 16. Case rod 22 is rigidly attached to and extends vertically upward mediate the upper bar 14, all as seen in the drawing.

The anchor arm 24 has two parallel slide rods 26 rigidly attached to and depending vertically downward from the lower bar 16. Locking plate 28 is rigidly attached to the lower bar 16 substantially parallel to the slide rods 26. The locking plate has a plurality of vertically aligned locking slots 30 in the lower part thereof.

Slide bar 32 has two slide holes therein. The slide holes are telescoped over the slide rods 26. The bottom of the locking plate 28 is rigidly attached to the ends of the slide rods 26 to provide a stop for the slide bar 32 which slides along the slide rods 26. It will be understood that other stop structure could be supplied.

Pad support 36 is pivoted to the slide bar 32. Locking prong 38 projects from the pad support 36 and engages one of the locking slots 30. The pad support 36 has pad tube 40 connected perpendicularly thereto. The pad tube 40 extends away from the torso of the painter when the belt clip 20 is attached to the belt on the painter.

Pad 42 is mounted on pad mount 43, which has pad rod 44 rigidly attached perpendicular thereto. The pad rod 44 is telescoped within the pad tube 40 with pad mount 43 adjacent the pad support 36.

Pin 46 extends perpendicularly from the pad rod 44 through pin guide 48 in the pad tube 40. Pin slots 50 emanate from the pin guide 48 in the pad tube 40 and provide for maintaining the pad rod at fixed positions within the pad tube 40.

Leather or chamois protector 52 is a flexible protector attached to the lower bar 16 and depends therefrom. The protector 52 is positioned between the pad 42 and the clothing or person of a painter to which the holder is attached. The protector 52 prevents movement of the pad from wearing the clothing of the painter.

The extension arm 54 is connected at one end to the upper and the lower bars 14 and 16. Case guides 56 are located atop the extension arm 54 distal of the case rod 22.

The paint case 60 has case tube 62 pivoted by pivot link 63 to the lip thereof. The case tube 62 removably telescopes over the case rod 22 on the supporting member 10, thereby permitting the paint case 60 to pivot with respect to the supporting member 10. Channel 64 bisects the bottom of the paint case 60 and is substantially in alignment with the attachment of the case tube 62 to the paint case 60. Wiping bar 66 within the paint case is located immediately above the projection of the channel 64 into the interior of the paint case 60. The paint case is liquid tight.

The case guides 56 are removably telescoped within the channel 64. With the case guides 56 engaged with the top of the channel 64, the paint case 60 is oriented with respect to the supporting member 10 in what I prefer to call the erect position. In this position the top of the paint case is horizontal when the painter is erect.

The paint case 60 may be pivoted with respect to the supporting member 10 and the case guides 56 removed from contact with the upper portion of the channels 64 to what I prefer to call the "crouching or kneeling" position. When the painter is bent at the waist, the top of the paint case 60 is about horizontal.

Locking arm 68 is connected to the supporting member 10 proximate the case rod 22. Locking eye 70 is connected to the paint case 60 immediately above the end of the channel 64. The locking arm may be hooked into the locking eye 70 to rigidly fix the paint case 60 in the kneeling position.

The paint case 60 is maintained in a horizontal orientation in the erect position while the painter is erect. The paint case may be pivoted to the kneel position if the painter must bend at the waist or crouch in order to paint baseboards, floors and the like. The paint case, with a large amount of paint therein, approximately a quart, may be employed by house painters and others requiring reasonably large amounts of paint.

For painters requiring less paint and more than one type or color of paint, removable circular cover 72 is affixed to the top of the paint case 60. The cover 72 has cover or locking slot 74 proximate one side thereof, and locking lug 76 diametrically opposite the cover slot 74.

The paint case has retaining tab 78 at the lip thereof and locking pin 80 diametrically opposite the tab 78 on the lip of the paint case 60. In order to secure the cover 72 to the paint case 60, the tab 78 is placed through the cover slot 74 and the locking pin 80 is inserted into the locking lug 76.

The cover 72 has three holes therein. For this embodiment, two paint cups 84 and cleaner cup 86 are telescoped through the holes. Retaining brackets 88 vertically position the cups 84 and 86 within the holes 82.

The cleaner cup 86 has brush wringer 90 therein. The brush wringer 90 includes rollers 92 rotatably mounted on wringer rods 94. The wringer rods 94 extend through wringer slots 96 in opposite sides of the cleaner cup 86. The wringer rods are springably biased away from each other by spring 98 located at one end thereof.

Handles 100 are located at the other ends from the spring 98 of the wringer rods 94. When squeezed together, the handles 100 bring the rollers 92 in contact.

When a brush is inserted into the cleaner cup 86 between the rollers 92, the handles 100 may be squeezed, thereby wringing the brush of cleaning fluid as it is withdrawn.

Caps 102 have retaining flanges 104 thereon. Each of the caps 102 has weight 106 affixed to one side thereof and cap cup 108 affixed to the other side thereof. Each of the cap cups 108 has wiping bar 110 therein.

Each cap cup 108 may be removably telescoped within the paint cups 84 when the caps 102 are placed upon the paint cups 84 with the cap cups 108 in the inverted position. The weights 106 fit within the paint cups 84 and the flanges 104 fit around the lip of the paint cups 84 when the caps 102 are placed upon the paint cups 84 with the cap cups 108 in the upright position.

When two colors are desired, the cap cups 108 may be placed in the upright position and paint placed therein. If more than two colors are desired, each of the caps 102 may be conveniently removed for access to paint in the paint cups 84 and replaced when the hand holding the cap is needed.

Figure 4:
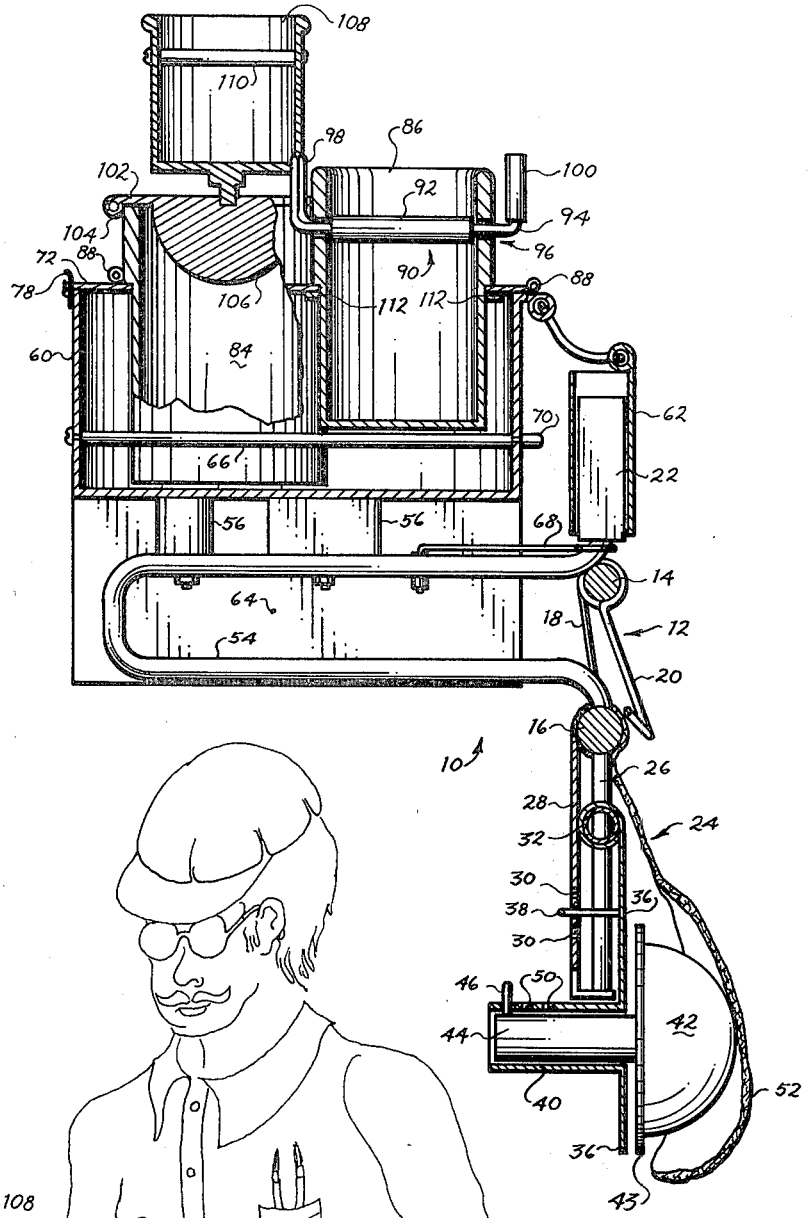
FIG. 4 is a side sectional view taken substantially on line 4—4 of FIG. 1 with the cap cups in the upright position and other parts broken away for clarity.
Figure 2:
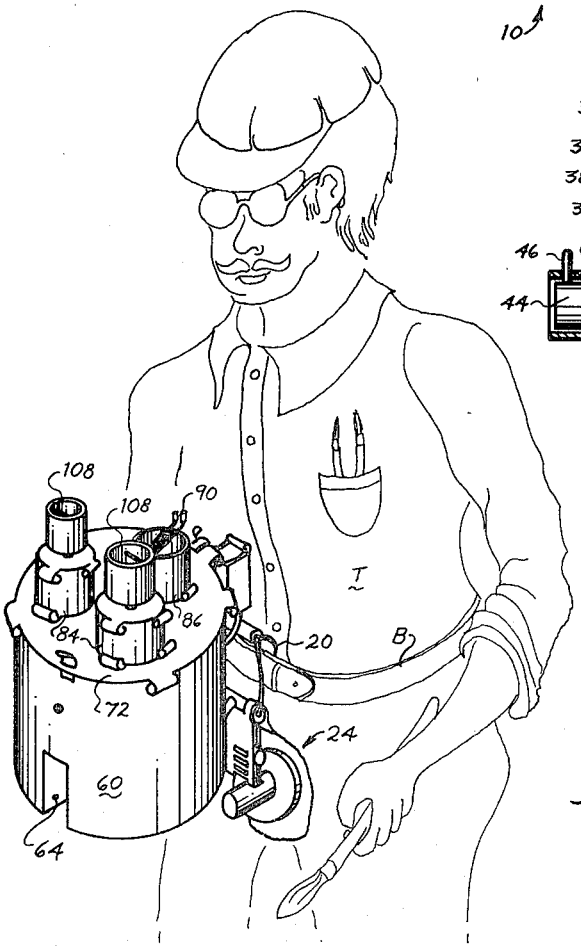
FIG. 2 is a perspective view thereof on a painter with the cap cups in the upright position.
Figure 5:
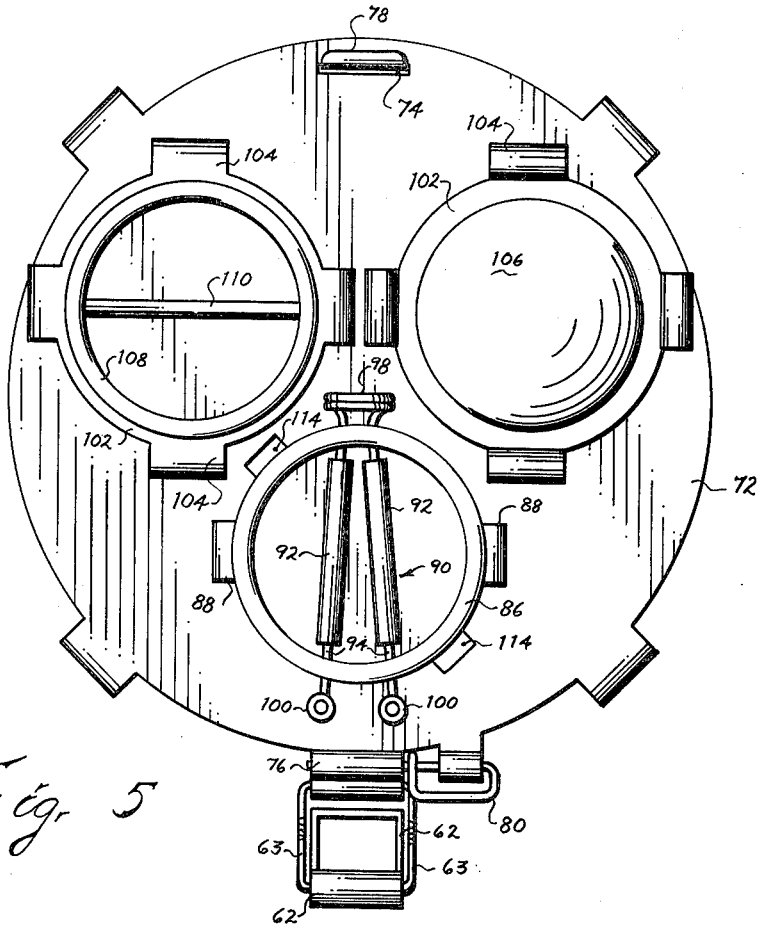
FIG. 5 is a top view of the paint case without the supporting member.
Figure 6:
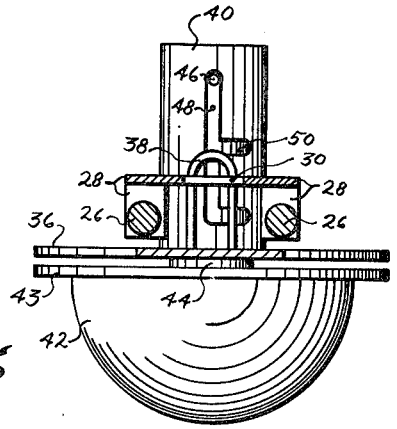
FIG. 6 is a top sectional view of the adjustment mechanism of the anchor arm taken substantially along line 6—6 of FIG. 1.

It will be understood that an alternate structure to the weights 106 to stabilize the paint caps and cap cups in the upright position could be to place tabs on each of the caps 102 where the weights are shown and to have these tabs engaging the inner sides of the paint cups 84. However, I prefer to employ the weights 106 as shown because they do not collect paint from the sides of the paint cups 84, as would the tabs. An optional bayonet-type mounting is shown in FIGS. 4 and 5, with bayonet tabs 112 inserted through bayonet slots 114 in the cover 72. The tabs 112 engage the bottom of the cover to retain the cleaner cup 86 within the paint case. This type of mounting could also be employed with the paint cups 84.

Therefore, I have invented a paint holder which is versatile and which places the desired supply of paint convenient to a painter while freeing his hands for other purposes.

As an aid to correlating the terms of the claims to the exemplary drawing, the following catalog of elements is provided:

| | | | |
|---|---|---|---|
| 10 | supporting member | 62 | case tube |
| 12 | base | 63 | pivot link |
| 14 | upper bar | 64 | channel |
| 16 | lower bar | 66 | wiping bar |
| 18 | braces | 68 | locking arm |
| 20 | belt clip | 70 | locking eye |
| 22 | case rod | 72 | removable cover |
| 24 | anchor arm | 74 | locking slot |
| 26 | slide rods | 76 | locking lug |
| 28 | locking plate | 78 | retaining tab |
| 30 | locking slots | 80 | locking pin |
| 32 | slide bar | 84 | paint cups |
| 36 | pad support | 86 | cleaner cup |
| 38 | locking prong | 88 | retaining brackets |
| 40 | pad tube | 90 | brush wringer |
| 42 | pad | 92 | rollers |
| 43 | pad mount | 94 | wringer rods |
| 44 | pad rod | 96 | wringer slots |
| 46 | pin | 98 | spring |
| 48 | pin guide | 100 | handles |
| 50 | pin slots | 102 | caps |
| 52 | protector | 104 | flanges |
| 54 | extension arm | 106 | weight |
| 56 | case guides | 108 | cap cups |
| 60 | paint case | 110 | wiper bars |
| | | 112 | bayonett tabs |
| | | 114 | bayonet slots |
| | | "T" | torso of painter |
| | | "B" | belt |

The embodiment shown and described above is only exemplary. I do not claim to have invented all the parts, elements or steps described. Various modifications can be made in the construction, material, arrangement, and operation, and still be within the scope of my invention. The limits of the invention and the bounds of the patent protection are measured by and defined in the following claims. The restrictive description and drawing of the specific example above do not point out what an infringement of this patent would be, but are to enable the reader to make and use the invention.

I claim as my invention:

1. The improved paint holder comprising:
a. a supporting member,
b. said supporting member being attached to the torso of a painter,
c. a paint case connected to and above said supporting member,
d. said paint case providing means for holding paint, and
e. said paint case being conveniently disposed frontally of said painter, thus
f. said paint holder providing means for placing a supply of paint convenient to the painter while freeing both hands for uses other than holding a paint container,
g. said paint case being pivotally mounted on said supporting member such that said paint case may be pivoted with respect to the torso of the painter, and
h. locking means on said supporting member for rigidly fixing said paint case in a position wherein the top of said paint case is horizontal to the ground and the bottom of said paint case is distal of said painter when said painter is bent over at the waist,
j. said pivotal mounting of the paint case being at the top thereof, and
k. said locking means being a locking arm extending from said supporting member to a ring on said paint case.

2. The improved paint holder comprising:
a. a supporting member,
b. said supporting member being attached to the torso of a painter,
c. a paint case connected to and above said supporting member,
d. said paint case providing means for holding paint, and
e. said paint case being conveniently disposed frontally of said painter, thus
f. said paint holder providing means for placing a supply of paint convenient to the painter while freeing both hands for uses other than holding a paint container,
g. said paint case having at least two paint cups suspended therein,
h. at least one of said paint cups having a cap thereon,
j. said cap covering the top of said paint cup,
k. said cap also having
(i) a cap cup mounted on one side thereof, and
(ii) a cap retainer on the other side thereof,
m. said cap cup removably telescoped within said cup when said cap is placed on said cup with said cap cup in an inverted position,
n. said cap retainer removably connecting said cap to said cup when said cap is on said cup with said cap cup in an upright position, o. said cap retainer providing means for stabilizing said cap cup with respect to said cup, and p. said cap cup providing means for holding additional materials.

3. The invention as defined in claim 2 further comprising:

q. wiping means within at least one of said cups for removing excess material from brushes.

4. The invention as defined in claim 2 further comprising:

q. said cap retainer is a weight fitting within said paint cup when said cap cup is upright.

5. The improved paint holder comprising:

a. a supporting member, b. said supporting member being attached to the torso of a painter, c. a paint case connected to and above said supporting member, d. said paint case providing means for holding paint, and e. said paint case being conveniently disposed frontally of said painter, thus f. said paint holder providing means for placing a supply of paint convenient to the painter while freeing both hands for uses other than holding a paint container, g. said paint case being detachable from said supporting member, h. said supporting member being mounted on a belt encircling the torso of said painter, and j. said supporting member including (i) an extension arm supporting said paint case, and (ii) an anchor arm connected to said extension arm bearing against said torso for maintaining said extension arm and paint case in an upright position with respect to said torso, k. a pad on said anchor arm at the point at which said anchor arm bears against the body of the painter, m. said anchor arm having (i) a vertical axis approximately parallel to said torso, and (ii) a transverse axis about perpendicular to said torso, n. a belt clip on said anchor arm proximate the connection of said supporting member to said paint case for mounting said supporting member on said belt, o. pad adjustment means for adjusting said pad along the transverse axis with respect to said anchor arm, and p. anchor adjustment means for adjusting the position of said pad on said anchor arm along the vertical axis with respect to said paint case.

6. The invention as defined in claim 5 further comprising:

q. said supporting member also having a base, r. said extension arm and said support arm connected to said base, s. said base including (i) a case rod telescoped within said case tube, (ii) an upper horizontal support bar connected to said extension arm, and (iii) a lower horizontal support bar connected to said extension arm, and (iv) said belt clip connected to said upper support bar opposite said extension arm for springably engaging said belt encircling the torso of said painter, t. said extension arm having channel guides thereon, u. said channel guides slidably engaging a channel in the bottom of said paint case, v. said support arm including (i) two parallel slide rods connected to and extending downwardly from said lower support bar, (ii) a slide bar having two holes therein telescoped over said slide rods, (iii) a pad support pivoted to said slide bar, (iv) a locking plate extending downward from said lower support bar proximate and parallel to said slide rods, (v) a plurality of locking slots in said locking plate, (vi) a locking prong extending from said pad support and engaging one of said locking slots, (vii) a pad tube connected to said pad support and having its center in said transverse plane, (viii) a pad rod telescoped within said pad tube, (ix) a pin extending from said pad rod, (x) said pin extending through a pin guide in said pad tube, (xi) pin slots emanating from said slot in said pad tube within said pad tube into which said pin may be positioned by rotating said pad rod, (xii) said pad connected to the end of said pad rod and oriented away from said paint case and bearing against said torso, and w. a flexible protector depended from said lower support rod and covering said pad for preventing friction of said pad against said painter.

7. The invention as defined in claim 5 further comprising:

q. said paint case having at least two paint cups suspended therein, r. at least one of said paint cups having a cap thereon, s. said cap covering the top of said paint cup, t. said cap also having (i) a cap cup mounted on one side thereof, and (ii) a cap retainer on the other side thereof, u. said cap cup removably telescoped within said cup when said cap is placed on said cup with said cap cup in an inverted position, v. said cap retainer removably connecting said cap to said cup when said cap is on said cup with said cap cup in an upright position, w. said cap retainer providing means for stabilizing said cap cup with respect to said cup, and x. said cap cup providing means for holding additional painting materials.

8. The invention as defined in claim 7 further comprising:

y. said paint case also having at least one cleaner cup holding brush cleaner for cleaning brushes suspended therein, z. a wiping bar within at least one of said cups for removing excess material from brushes, aa. a brush wringer in at least one of said cups providing means for removing excess material from a brush, bb. said brush wringer including two rods springably spaced apart proximate the top of said cup, cc. handles connected to said rods providing means for forcing said rods together when said handles are squeezed together.

9. The invention as defined in claim 8 further comprising:

dd. said paint case being pivotally mounted on said supporting member such that said paint case may be pivoted with respect to the torso of the painter, ee. locking means on said supporting member for rigidly fixing said paint case in a position wherein the top of said paint case is horizontal to the ground and the bottom of said paint case is distal of said painter when said painter is bent over at the waist, ff. said pivotal mounting of the paint case being at the top thereof, and gg. said locking means being a locking arm extending from said holder to a ring on said paint case.

10. The invention as defined in claim 9 further comprising:

hh. said paint case including (i) a channel at the bottom of said paint case extending diametrically through the bottom thereof, (ii) a wiping bar within said paint case extending diametrically thereof, (iii) a circular cover atop said paint case, and (iv) said cover having a plurality of holes therein, (v) said cover being removable, (vi) a locking pin on said paint case, (vii) a locking lug on said cover, (viii) a retaining tab on said paint case opposite said locking pin, (ix) a locking slot in said cover, (x) said locking pin engaging said locking loop and said tab engaging said slot for retaining said cover on said paint case, jj. each of said paint cups fitting within one of said holes, kk. said cleaning cup fitting within one of said holes, mm. tabs on the sides of said paint cups and said cleaning cup for vertically positioning said cups within said holes, nn. said cap retainer is a weight fitting within said cup when said cap cup is upright, and oo. said pivotal mounting of said paint case to said supporting member being a case tube telescoped over a case rod on said supporting member.

11. The invention as defined in claim 10 further comprising:

pp. said supporting member also having a base, qq. said extension arm and said support arm connected to said base, rr. said case rod being rigidly connected to said base, ss. said base including (i) an upper horizontal support bar connected to said extension arm, (ii) a lower horizontal support bar connected to said extension arm, and (iii) said belt clip connected to said upper support bar opposite said extension arm for springably engaging said belt encircling the torso of said painter, tt. said extension arm having channel guides thereon, uu. said channel guides slidably engaging said channel in the bottom of said paint case, vv. said support arm including (i) two parallel slide rods connected to and extending downwardly from said lower support bar, (ii) a slide bar having two holes therein telescoped over said slide rods, (iii) a pad support pivoted to said slide bar, (vi) a locking plate extending downward from said lower support bar proximate and parallel to said slide rods, (v) a plurality of locking slots in said locking plate, (vi) a locking prong extending from said pad support and engaging one of said locking slots, (vii) a pad tube connected to said pad support and having its center in said transverse plane, (viii) a pad rod telescoped within said pad tube, (ix) a pin extending from said pad rod, (x) said pin extending through a pin guide in said pad tube, (xi) pin slots emanating from said slot in said pad tube within said pad tube into which said pin may be positioned by rotating said pad rod, (xii) said pad connected to the end of said pad rod and oriented away from said paint case and bearing against said torso, and ww. a flexible protector depended from said lower support rod and covering said pad for preventing friction of said pad against said painter.

* * * * *